US011774047B2

(12) United States Patent
Van Bommel et al.

(10) Patent No.: US 11,774,047 B2
(45) Date of Patent: Oct. 3, 2023

(54) LED STRIP CONFIGURTIONS FOR LARGE AREA ROUND LUMINAIRES PROVIDING HOMOGENEOUS LIGHTING

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING, B.V., Eindhoven (NL)

( * ) Notice: Subject to any disclaimer, the term of this patent is extended or adjusted under 35 U.S.C. 154(b) by 150 days.

(21) Appl. No.: 17/609,712

(22) PCT Filed: May 4, 2020

(86) PCT No.: PCT/EP2020/062248
§ 371 (c)(1),
(2) Date: Nov. 8, 2021

(87) PCT Pub. No.: WO2020/229206
PCT Pub. Date: Nov. 19, 2020

(65) Prior Publication Data

US 2022/0221113 A1 Jul. 14, 2022

(30) Foreign Application Priority Data

May 13, 2019 (EP) ..... 19173982

(51) Int. Cl.
*F21K 9/62* (2016.01)
*F21Y 103/10* (2016.01)
*F21Y 115/10* (2016.01)

(52) U.S. Cl.
CPC ..... *F21K 9/62* (2016.08); *F21Y 2103/10* (2016.08); *F21Y 2115/10* (2016.08)

(58) Field of Classification Search
CPC ..... F21K 9/62
See application file for complete search history.

(56) References Cited

U.S. PATENT DOCUMENTS 5,559,681 A * 9/1996 Duarte ..... F21V 21/0808 362/249.14
6,371,637 B1 * 4/2002 Atchinson ..... F21V 19/005 362/555

(Continued)

FOREIGN PATENT DOCUMENTS

CN 201661918 U 12/2010
CN 204268400 U 4/2015

(Continued)

*Primary Examiner* — Bryon T Gyllstrom

(57) ABSTRACT

The disclosure concerns a light-emitting module (100) comprising one or more flexible, elongated light-emitting diode, LED, strips (110) and a mixing chamber (150). Each LED strip comprises a first side (112) on which a plurality of LEDs (111) is mounted, a second side (113) opposite to said first side, and two lengthwise edges (114). The mixing chamber (150) is arranged to mix light emitted by said LEDs and comprises a base (151). One of the lengthwise edges (144) of each LED strip is arranged to face the base (151) of the mixing chamber. At least a portion of each LED strip (110) is bent (or folded) to extend radially from a center portion of the mixing chamber towards one or more outer points (132), so that the one or more light-emitting diode strips (110) together form a number N of elongated arms (130). Each elongated arm comprises two segments of the LED strip, where the segments form opposite sides of the elongated arm.

14 Claims, 9 Drawing Sheets

(56) References Cited

U.S. PATENT DOCUMENTS

| | | | | |
|---|---|---|---|---|
| 8,314,566 | B2 * | 11/2012 | Steele | F21V 3/02 362/249.02 |
| 8,322,881 | B1 * | 12/2012 | Wassel | F21V 7/048 362/217.05 |
| 8,511,849 | B2 * | 8/2013 | Sloan | H05B 45/00 362/225 |
| 9,512,977 | B2 * | 12/2016 | Pickard | F21V 7/0066 |
| 11,168,843 | B2 * | 11/2021 | Jiang | F21K 9/61 |
| 2013/0170175 | A1 * | 7/2013 | Negley | F21K 9/232 362/249.02 |
| 2015/0252996 | A1 * | 9/2015 | Kadijk | F21K 9/64 362/249.02 |
| 2016/0312965 | A1 * | 10/2016 | Hikmet | F21V 7/28 |
| 2018/0100624 | A1 | 4/2018 | Bergenek et al. | |

FOREIGN PATENT DOCUMENTS

| | | | |
|---|---|---|---|
| CN | 103470973 | U | 7/2015 |
| EP | 3136829 | A1 | 3/2017 |
| WO | 2015101547 | A1 | 7/2015 |
| WO | 2016198431 | A1 | 12/2016 |

* cited by examiner

LED STRIP CONFIGURTIONS FOR LARGE AREA ROUND LUMINAIRES PROVIDING HOMOGENEOUS LIGHTING

CROSS-REFERENCE TO PRIOR APPLICATIONS

This application is the U.S. National Phase application under 35 U.S.C. § 371 of International Application No. PCT/EP2020/062248, filed on May 4, 2020, which claims the benefit of European Patent Application No. 19173982.0, filed on May 13, 2019. These applications are hereby incorporated by reference herein.

TECHNICAL FIELD

The present disclosure generally relates to the field of solid state lighting, and more specifically to light-emitting modules comprising a flexible light-emitting diode strip and a mixing chamber. The disclosure further relates to methods for producing such light-emitting modules.

BACKGROUND

Today, the market presents a large variety of light-emitting modules comprising different types of light sources. A common requirement for many light-emitting modules is to be able to provide uniform illumination.

Light-emitting diode based lighting solutions are highly appreciated due to their energy efficiency, long lifetime and lower use of potentially harmful materials. As light-emitting diodes are point sources, however, these have shown to be problematic to provide uniform illumination.

Various approaches have been used in order to combine the energy efficiency of LED-based light-emitting modules with uniform illumination. Such approaches include structures which allow for coupling of LED light into solid waveguides. This solution may, however, lead to losses, as such solid waveguides may absorb light. Another solution has been to arrange a large number of LEDs at the bottom of a light-mixing chamber and provide a diffuser to spread the light evenly. However, using such a large number of LEDs may prove costly, and placing the LEDs closely may lead to excess heating.

In WO2015101547, a round light-mixing chamber with a diffusive exit window is combined with a set of LEDs arranged on the inside of the sidewall of the mixing chamber. This solution provides uniform illumination for smaller light-emitting modules. However, the ability to provide uniform lighting may decrease for larger area modules.

There is thus a need for alternative light-emitting modules able to provide homogeneous illumination.

SUMMARY OF THE INVENTION

It is therefore an object of the present invention to overcome at least some of the above mentioned drawbacks, and to provide improved light-emitting modules and/or an improved method for production of such light-emitting modules.

This and other objectives are achieved by means of a light-emitting module and a method as defined in the appended independent claims. Other embodiments are defined by the dependent claims.

According to a first aspect of the present disclosure, there is provided a light-emitting module comprising one or more flexible, elongated light-emitting diode (LED) strips and a mixing chamber. Each of the one or more LED strips comprises a first side (front side), a second side (backside) opposite to the first side, and two lengthwise edges. A plurality of LEDs is mounted on the first side of the LED strip.

The mixing chamber (light-mixing chamber) is arranged to mix light which is emitted by the LEDs. The mixing chamber has a base. One of the lengthwise edges of each of the one or more LED strips is arranged to face the base.

Further, at least a portion of each of the one or more LED strips is bent (or folded) to extend radially from a center portion of the chamber toward one or more outer points. Through the bending/folding, the one or more LED strips together form a number N of elongated arms, each elongated arm comprising two segments of one of the one or more LED strips. The two segments form opposite sides of the elongated arm. The number N of elongated arms is equal to or larger than 3.

In the light-emitting module according to the first aspect, each of the one or more LED strips is bent or folded to form one or more of the radially-extending elongated arms. Each of the radially-extending elongated arms may be formed by a different bent or folded LED strip. Alternatively, all of the radially-extending elongated arms together may be formed by one bent or folded LED strip.

In the light-emitting module according to the first aspect, the one or more flexible, elongated light-emitting diode strips may be a flexible, elongated light-emitting diode strip of which at least a portion is bent to extend radially from the center portion of the mixing chamber towards a number N of outer points, thereby forming the number N of elongated arms. In other words, this light-emitting module comprises (i) a flexible, elongated light-emitting diode strip, having a first side on which a plurality of light-emitting diodes is mounted, a second side opposite to the first side, and two lengthwise edges, and (ii) a mixing chamber arranged to mix light emitted by the light-emitting diodes, the mixing chamber having a base. One of the lengthwise edges is arranged to face the base of the mixing chamber. At least a portion of each the light-emitting diode strip is bent to extend radially from a center portion of the mixing chamber (150) towards a number N of outer points, thereby forming a number N of elongated arms. Each elongated arm comprises two segments of the light-emitting diode strip, the segments forming opposite sides of the elongated arm. The number N is larger than or equal to 3. In this light-emitting module, there is at least one flexible, elongated LED strip, and this particular LED strip is bent or folded to form at least three elongated arms.

The light-emitting module is configured to emit light-emitting module light, which comprises light emitted by the LEDs of the LED strip and mixed within the mixing chamber.

The LEDs may be arranged in one row on the first side. The LEDs may be arranged at even distances on the LED strip. Alternatively, the distance between the LEDs may differ along the LED strip. The distance between two neighboring LEDs is referred to as LED pitch. It will be appreciated that the arrangement of the LEDs on the LED strip is such that each elongated arm comprises at least one LED. The LEDs may be arranged only on one side of an elongated arm, or on both sides.

LEDs are point-sources, that is, they provide light from a small area. Placing the LEDs in a mixing chamber may allow the light to reflect within the chamber and to be mixed. As the light from the plurality of LEDs is reflected and mixed within the mixing chamber, the light may become more randomly directed and, thus, the light emitted by the light-emitting module may become more homogeneous.

In some embodiments, every elongated arm may have substantially the same length. Alternatively, the length of the elongated arms may vary. Specifically, there may be a repeating pattern to the lengths of the elongated arms, for instance a pattern in which every other arm has a longer length, and every other arm has a shorter length. In other embodiments, the length of the arms is adapted to the shape of the base of the mixing chamber.

As an example, the length of an arm may be at least 10 cm. Specifically, the length of an arm may be at least 15 cm. More specifically, the length of an arm may be at least 20 cm. Even more specifically, the length of an arm may be at least 25 cm, such as for example 30 cm.

As an example, the LED strip may have a width (i.e. the width of the first side, the shortest distance between the lengthwise edges), in this disclosure denoted W2, that is in the range 3-30 mm. Specifically, the LED strip may have a width (W2) that is in the range 5-25 mm. More specifically the LED strip may have a width (W2) that is in the range 6-20 mm. Such LED strips may provide mechanical strength while not obstructing the mixing of light within the mixing chamber.

In other words, the width (W2) of the LED strip may be smaller than the height, in this disclosure denoted H, of the mixing chamber. As an example, the width of the LED strip (W2) and the height of the mixing chamber (H) may be such that $0.05H<W2<0.5H$. Specifically, the relation between W2 and H may be such that $0.1H<W2<0.5\ H$. More specifically, the relation between W2 and H maybe such that $0.15H<W2<0.35H$.

The arrangement of the LED strip with a lengthwise edge facing the base may result in that light is emitted from the LEDs towards a side wall of the mixing chamber, i.e. in a direction substantially parallel to the base. Such a configuration improves light-mixing within the chamber. Enhanced light-mixing may in turn contribute to a more uniform lighting. Specifically, the LEDs may be top emitters (i.e. LEDs emitting light through a top surface, and not through side surfaces). Such LEDs in combination with the arrangement of the LED strip as described above, may result in more LED light being directed substantially parallel to the base of the mixing chamber, which may in turn increase the uniformity of the light-emitting module light.

Folding one or more LED strips to extend as elongated arms from a center portion of the mixing chamber may provide a more homogeneous illumination from substantially round or oval light-emitting modules. Specifically, the center portion of the mixing chamber may the same as, or directly above, a center portion of the base. Further, smaller or larger modules providing uniform lighting may be achieved as the bending of the LED strip may result in shorter or longer elongated arms.

According to some embodiments, the lengthwise edge of the LED strip which is arranged to face the base of the mixing chamber may more specifically be arranged against the base. This may improve the stability of the arrangement.

According to some embodiments, the lengthwise edge facing the base may be arranged in proximity of the base, i.e. with a (small) gap between the base and the lengthwise edge facing the base. In proximity of the base may be understood as in the bottom half of the mixing chamber, or, even more specifically, in the bottom half of the bottom half (i.e. the bottom fourth) of the mixing chamber. For example, the gap may be smaller than 3 cm. Specifically, the gap may be smaller than 1 cm. More specifically, the gap may be smaller than 0.1 cm.

For example, the LED strip may be held in place using a structure which may be in contact with, or form part of, the base or a sidewall of the mixing chamber. Such holding means could for example comprise a pin.

Arranging the LED strip away from the base may result in less heat development, and thus a reduction in the necessity of cooling. Arranging the LED strip in proximity of the base may result in more light-mixing, and thus improved uniformity of the light emitted by the light-emitting module.

According to some embodiments, at least a segment of the LED strip may comprise a LED pitch gradient. The arrangement of the at least one segment may be such that the LED pitch decreases along the elongated arm from the center portion of the base towards the outer point. The at least one segment comprising the LED pitch gradient may be arranged along an elongated arm of the folded portion of the LED strip.

The elongated arms may become more distant from one-another as they extend further away from the center portion (of the base) of the mixing chamber. Decreasing the LED pitch, i.e. the distance between successive LEDs, may counteract the increasing distance between the elongated arms towards the outer points, and may thus provide a more uniform light distribution.

According to some embodiments, at least a section of the LED strip, between a first LED and a second, successive LED, may be folded in order to shorten the pitch between the first LED and the second LED. In these embodiments, a LED strip having an even pitch, which may be cheaper and/or easier to produce, may be used while still improving the uniformity of light by altering the LED pitch.

According to some embodiments, the LEDs may be arranged on the LED strip so that the LED strip comprises regions with LEDs and regions without LEDs. The bending of at least a part of the LED strip may be such that each region without LEDs may be arranged along a side of an elongated arm facing a side of a neighboring arm having LEDs. In other words, each region without LEDs faces a region with LEDs located along a neighboring elongated arm.

The length of an elongated arm may be denoted L1. The length of a region without LEDs, L2, may be related to L1 through $0.4L1<L2<L1$. Specifically, the length of the region without LEDs may be related to L1 through $0.5L1<L2<L1$. More specifically, the length of a region without LEDs may be related to L1 through $0.7L1<L2<L1$ Most specifically, the length of a region without LEDs may be related to L1 through $0.9L1<L2<L1$.

Specified differently, the length of a region without LEDs may be at least 3 cm. Specifically, the length of a region without LEDs may be at least 4 cm. More specifically, the length of a region without LEDs may be at least 5 cm. Even more specifically, the length of a region without LEDs may be at least 6 cm.

These embodiments may offer an alternate, or complementary, solution for providing a more uniform lighting. Further, arranging regions without LEDs in areas where the LEDs may otherwise, due to the bending of the LED strip, be more densely arranged may decrease excess heat in such areas. Further, having regions without LEDs facing regions with LEDs may ensure that no (or at least less) dark spots, i.e. spots not illuminated by the LEDs, are created. Arrangement of sections with and without LEDs may also aid in obtaining a more uniform lighting depending on the bending of the LED strip. For example, LED-free regions may be arranged in areas in which the distance between elongated arms is shorter and avoided in areas where the distance is longer.

According to some embodiments, the number N of elongated arms may be in the range 5-14. Specifically, the number N of elongated arms (and thus outer points) may be in the range 6-12. More specifically, N may be in the range 7-11. Even more specifically, the number N may be in the range 8-10. These ranges may provide a more uniform light-distribution and contribute to fewer dark spots on the light-emitting module.

According to some embodiments, the angle between two neighboring arms may be $\theta=360/N$. Specifically, the angle between each pair of neighboring arms may be $\theta=360/N$. This embodiment may provide a more uniform light distribution in that the arms are distributed evenly around 360° (i.e. the outer points are distributed along the circumference of a circle).

According to some embodiments, at least a portion of the LED strip may be arranged along an arc of a circle between the outer points of at least two elongated arms. It will be appreciated that the portion of the LED strip which is arranged along an arc of a circle comprises at least one LED.

According to some embodiments, the portion which is arranged along an arc of a circle may be arranged with its second side against a circumferential sidewall of the mixing chamber. Arranging the second side towards a circumferential sidewall may direct the LEDs inwards so that they face the interior of the mixing chamber. This may improve the uniformity of the light emitted by the LEDs into the mixing chamber, especially for larger modules where the LED strip along the sidewall complements the arrangement extending from the center portion of the base.

According to some embodiments, the LED strip may be arranged with at least N−1 valley folds at the center portion of the mixing chamber, and with at least N−1 mountain folds forming at least N−1 outer points.

In this disclosure, a valley fold is characterized by two segments of the LED strip, on either side of the fold, being folded so that the angle between their respective first sides decrease. In other words, in a valley fold, the LED strip is folded so that two segments of the LED strip, on the side having LEDs, approach one another. A valley fold results in an angle between the two first sides of the segments which is smaller than 180°.

A mountain fold is made by folding two segments of LED strip, on either side of the fold, so that the first sides of the segments are folded away from one another. A mountain fold results in an angle between the two first sides of the segments which is larger than 180°. The outer points of the LED strip arrangement may be defined by mountain folds.

According to some embodiments, at least one segment of the LED strip, which forms a side of an elongated arm from one of the mountain folds (i.e. outer points) to one of the valley folds (at the center portion of the base), is substantially straight. Alternating mountain and valley folds, with substantially straight segments in between, results in a star-like shape. Such a shape may provide improved light-homogeneity.

According to some embodiments, the two segments of the LED strip forming opposite sides of an elongated arm may, along at least a portion of the elongated arm, be glued together on their respective second sides. This embodiment may provide improved thermal management.

According to some embodiments, the LEDs may be arranged on the LED strip so that LEDs on opposite sides of the elongated arm are interleaved. In other words, there may be an offset in the direction of the extension of the elongated arm (i.e. towards an outer point), between the LEDs arranged along one side of the elongated arm and the LEDs arranged along the opposite side of the elongated arm. This embodiment may lead to improved thermal management, as the LEDs may be more evenly distributed along the arm.

According to some embodiments, the mixing chamber may further comprise a semi-reflective light exit window. The semi-reflective light exit window may be at least partially transmissive for visible light. Further, the light exit window may be arranged to couple out light which has been emitted by the LEDs and has been mixed within the mixing chamber. For example, the reflectance of the semi-reflective light exit window may be in the range from 30-80% for light emitted by the plurality of LEDs. Specifically, the reflectance may be in the range 35-70%. More specifically, the reflectance may be in the range 38-65%. Even more specifically, the reflectance may be in the range 40-60%.

A semi-reflective light exit window may increase mixing of the light emitted by the LEDs, as some light is reflected back into the mixing chamber. Too high reflectance may result in a loss of efficiency. Increased mixing may allow the light-emitting module to provide a more uniform illumination.

According to some embodiments, the mixing chamber may have a width (e.g. a diameter or a longest side), in this disclosure denoted W1, and a height, H. An aspect ratio of the width and the height (i.e. W1/H) may be in the range 8-60. Specifically, the aspect ratio may be in the range 10-30. More specifically, the aspect ratio may be in the range 12-20.

Further, the width W1 may be larger than 20 cm. Specifically, the width W1 may be larger than 40 cm. More specifically, the width W1 may be larger than 50 cm, such as for example 60 cm.

Light-emitting modules are often mounted in ceilings or even recessed into ceilings. Thus, having a low height (H) is often desired. A large aspect ratio may allow a low height while still providing more illumination. However, if the height is too low, the mixing characteristics of the mixing chamber may be impaired, which could lead to a decrease in the uniformity of the illumination.

According to a second aspect of the disclosure, a method for producing a light-emitting module is provided. The method may result in a light-emitting module in accordance with any of the embodiments described in relation to the first aspect of the disclosure. The method comprises providing a mixing chamber having a base and providing one or more flexible, elongated light-emitting diode (LED) strips, each with a first side, a second side, and two lengthwise edges. On the first side, a plurality of LEDs is arranged. The LEDs may be arranged in one row on the first side. The LEDs may also be arranged at even intervals on the LED strip, or with varying intervals.

Further, the method comprises arranging, for each of the one or more LED strips, one of the lengthwise edges of the LED strip to face the base of the mixing chamber and bending at least a portion of each of the one or more LED strips to form a number N of elongated arms extending radially from a center portion of the chamber towards a number N of outer points. Each elongated arm comprises two segments of at least one of the one or more LED strips which form opposite sides of the elongated arm.

It is noted that other embodiments using all possible combinations of features recited in the above described embodiments may be envisaged. Thus, the present disclosure also relates to all possible combinations of features mentioned herein. Any embodiment described herein may be combinable with other embodiments also described herein, and the present disclosure relates to all combinations of features. In particular, it will be appreciated that the specific embodiments described with reference to the first aspect of the disclosure apply also to the method according to the second aspect of the present disclosure.

BRIEF DESCRIPTION OF THE DRAWINGS

Exemplifying embodiments will now be described in more detail, with reference to the following appended drawings.

As illustrated in the figures, the sizes of the elements and regions may be exaggerated for illustrative purposes and, thus, are provided to illustrate the general structures of the embodiments. Like reference numerals refer to like elements throughout.

DETAILED DESCRIPTION OF THE EMBODIMENTS

Exemplifying embodiments will now be described more fully hereinafter with reference to the accompanying drawings, in which currently preferred embodiments are shown. The invention may, however, be embodied in many different forms and should not be construed as limited to the embodiments set forth herein; rather, these embodiments are provided for thoroughness and completeness, and fully convey the scope of the invention to the skilled person.

Figure 1A:
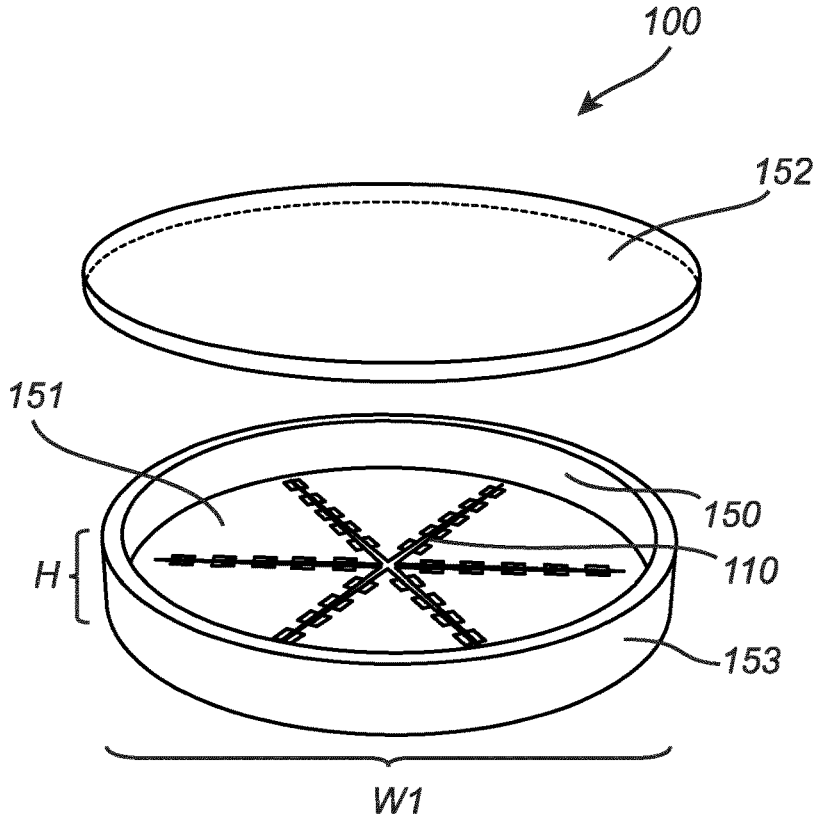
FIGS. 1*a-b* show schematic illustrations of a light-emitting module in accordance with some embodiments.
Figure 1B:
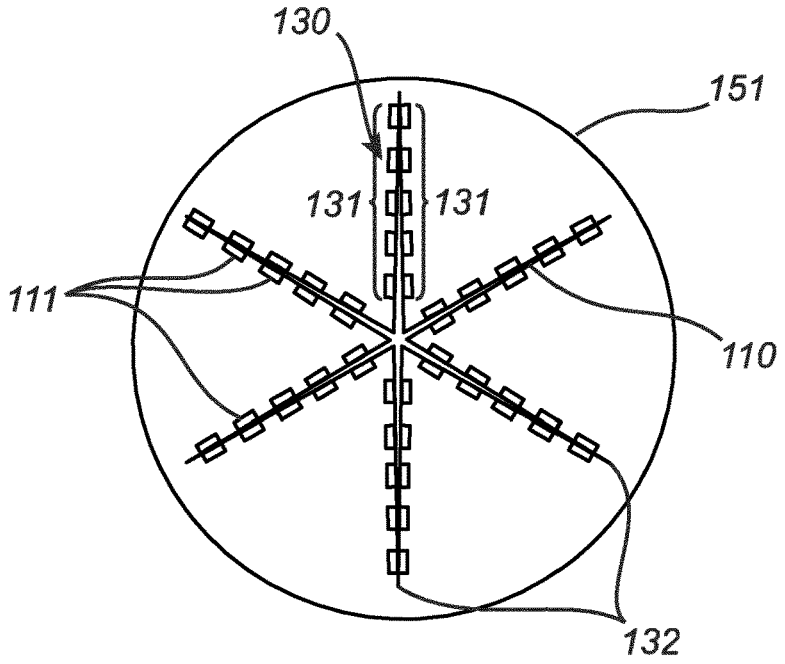

Referring to FIGS. 1*a-b*, a light-emitting module according to some embodiments will be described.

FIG. 1*a* shows a schematic view of a light-emitting module 100 in accordance with some embodiments. The light-emitting module 100 comprises a light-mixing chamber 150 having a base 151, a semi-reflective exit window 152 and a side-wall 153. The light-emitting module comprises also a flexible, elongated LED strip 110. The light-emitting module 100 has a width W1 and a height H. The semi-reflective exit window 152 is detached from the module 100 in order to show the inside of the mixing chamber 150. During operation, the exit-window 152 would be attached to the sidewall 153 of the module 100. The base 151 and the sidewall 153 of the light-emitting module 100 together form a cavity (or chamber/container) in which the LED strip 110 may be placed.

FIG. 1*b* is a plan view of the inside of the mixing chamber. The LED strip 110 is shown to be arranged on, or in proximity of, the base 151 of the mixing chamber 150. The LED strip 110 comprises a plurality of LEDs 111. The LED strip 110 is folded to form elongated arms 130 which extend radially from a center portion of the base 151 towards a number N of outer points 132. In the present embodiment N=6. Each elongated arm 130 is composed of two segments 131 of the LED strip 110, which form opposite sides of the elongated arm 130.

The base 151 of the mixing chamber 150 in the present light-emitting module 100 has a circular shape, which in combination with the circumferential side wall 153 gives the mixing chamber 150 a cylindrical shape. It will however be appreciated that the mixing chamber may have other shapes. In particular, the base 151 may for example have an oblong, elliptical, or oval shape.

The base 151 and/or the sidewall 153 may have highly reflective inside surfaces. Highly reflective may mean that the reflectance is in the range 90-100%. For example, the reflectance may be higher than 92%. Specifically, the reflectance may be higher than 94%. More specifically, the reflectance may be higher than 95%.

The arrangement of the LED strip 110 is such that a lengthwise edge of the LED strip 110 is arranged to face the base 151. Specifically, in the present embodiment, the LED strip 110 is arranged against the base 151. This leads to the plurality of LEDs 111 being arranged so that light emitted from the LEDs is directed towards the side wall 153 of the mixing chamber, i.e. in a direction substantially parallel to the base 151. The LEDs 111 may be top emitters, emitting light through a top surface. Such LEDs, in combination with the arrangement of the LED strip 110, may result in more LED light being directed substantially parallel to the base 151, which may in turn increase the uniformity of the light emitted by the light-emitting module.

Further, the arrangement of the LED strip 110 places the LEDs 111 facing away from the elongated arms 130 on which they are arranged. As a result, light emitted by the LEDs 111 may be emitted into the mixing chamber 150 for mixing within the mixing chamber 150.

The LEDs 111 may be white LEDs, i.e. LEDs emitting light with a correlated color temperature (CCT) in the range 2000-8000 K. Specifically, the LEDs 111 may be adapted to emit light in the CCT-range 2500-7000 K. More specifically, the LEDs 111 may be adapted to emit light in the CCT-range 2700-5000 K.

The LEDs 111 may further be adapted to emit white light which is within 10 SDCM (Standard Deviation of Color Matching) from the black body locus (BBL). Specifically, the LEDs 111 may be adapted to emit white light which is within 8 SDCM of the BBL. More specifically, the LEDs 111 may be adapted to emit light within 5 SDCM of the BBL.

Further, the LEDs 111 may have a color rendering index (CRI) of at least 80. Specifically, the LEDs 111 may have a CRI of at least 85. More specifically, the LEDs 111 may have a CRI of at least 88.

In some embodiments, the number of LEDs on an elongated arm may be at least 5. Specifically, the number of LEDs on an elongated arm may be at least 8. More specifically, the number of LEDs on an elongated arm may be at least 10.

The semi-reflective exit window 152 may be arranged on top of the mixing chamber 150 (for example in contact with the side wall 153, on the opposite side of the base 151), to couple out light emitted by the LEDs 111 and mixed within the mixing chamber 150. The semi-reflective window 152 may for example have a reflectance in the range 30-80% for light emitted by the LEDs, such that 30-80% of the light is reflected back into the chamber for further mixing. Specifically, the reflectance may be in the range 35-70%. More specifically, the reflectance may be in the range 38-65%. Even more specifically, the reflectance may be in the range 40-60%. In the present embodiment, the width W1 of the module 100 corresponds to the diameter of the base 151, and the height H corresponds to the height of the sidewall 153. In other embodiments, having differently shaped bases, the width W1 may refer to another widest dimension of the base. An aspect ratio (W1/H) of the width W1 and the height H may be in the range 8-60. More specifically, W1/H may be in the range 9-30. Most specifically, W1/H may be in the range 10-20.

Figure 2:
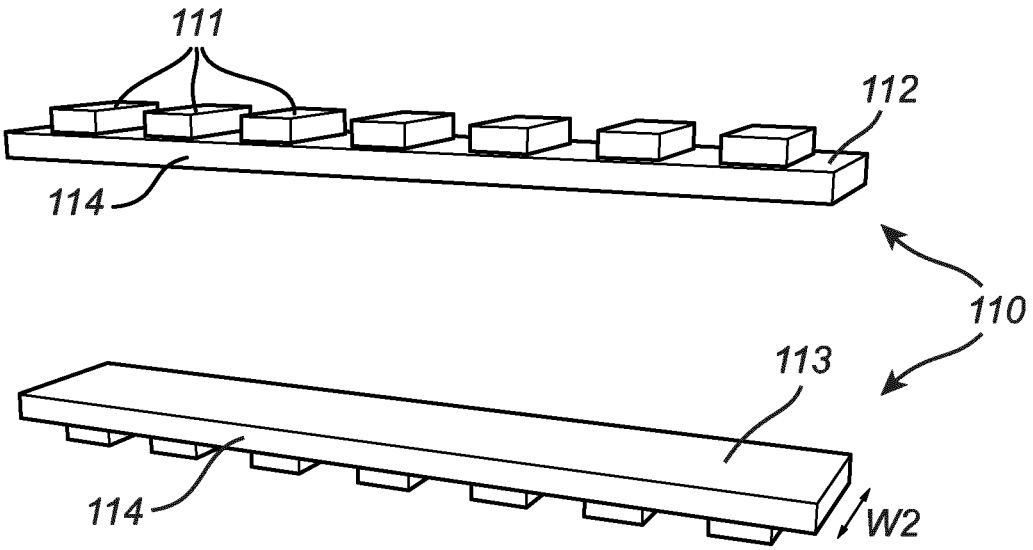
FIG. 2 shows schematic views of a part of a LED strip in accordance with some embodiments.

With reference to FIG. 2, a LED strip in accordance with some embodiments will be described.

FIG. 2 shows two views of the same LED strip 110, like the one described with reference to FIG. 1, one seen at an angle from above, and another one seen from below. The LED strip 110 is elongated and flexible, in particular it is bendable (foldable). It comprises a first side (front side) 112 on which a plurality of LEDs 111 is mounted. It further comprises a second side (backside) 113, which is opposite to the first side 112. Connecting the first side 112 and the second side 113, along the elongation of the LED strip 110, are two lengthwise edges 114 which correspond to the thickness of the LED strip 110. When the LED strip 110 is arranged within a light-emitting module, such as the module 100 of FIG. 1*a*, one of the lengthwise edges 114 may be arranged to face, such as against or in proximity of, the base (151 in FIGS. 1*a-b*) of the mixing chamber.

The plurality of LEDs 111 (in the figure represented by seven LEDs 111) may be arranged in one row on the first side 112 of the LED strip 110 in the direction of the longitudinal extension of the LED strip 110. In some embodiments, the LEDs 111 may be equidistantly arranged in one row. However, in some other embodiments, the distance between successive LEDs 111 may vary.

The LED strip 110 has a width W2. The width W2 may be in the range 3-30 mm. Specifically, the width W2 may be in the range 5-25 mm. More specifically the width W2 may be in the range 6-20 mm. These widths may provide mechanical strength to the LED strip so it may be arranged as described above, while not obstructing the mixing of light within the mixing chamber.

Differently specified, the width W2 may be smaller than the height of the mixing chamber (H in FIG. 1*a*). As an example, the width W2 and the height H (FIG. 1*a*) may fulfill the condition that $0.05H<W2<0.5H$. Specifically, the width W2 and height H (FIG. 1*a*) may fulfill the condition that $0.1H<W2<0.5$ H. More specifically, the relation between the width W2 and the height H (FIG. 1*a*) may fulfill the condition that $0.15H<W2<0.35H$.

Figure 3A:
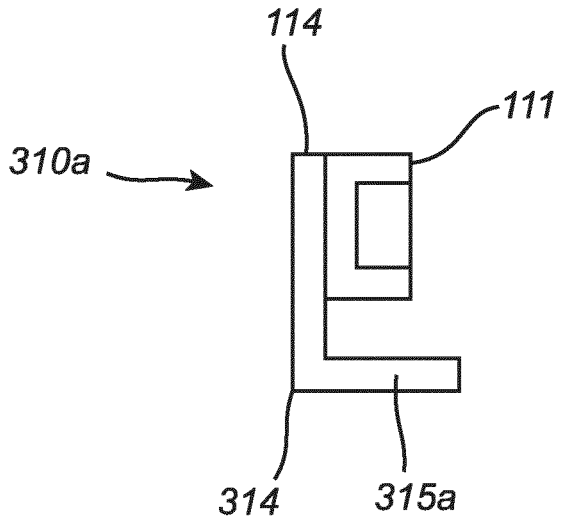
FIGS. 3*a-c* illustrate LED strips adapted to be arranged at the base of a mixing chamber in accordance with some embodiments.
Figure 3B:
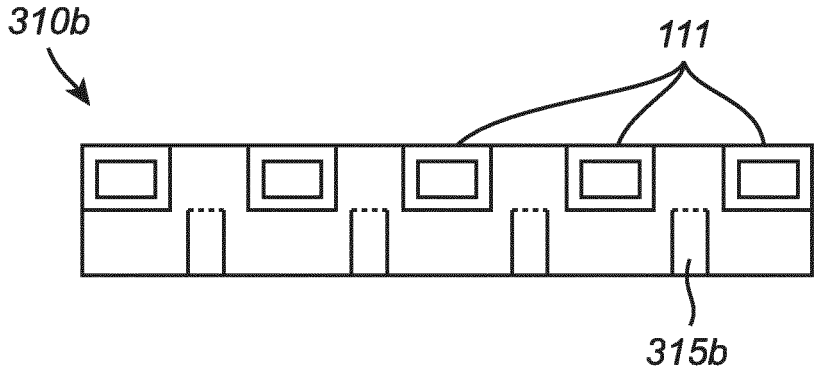

With reference to FIGS. 3*a-b*, embodiments of LED strips having supports or other features for arranging a lengthwise edge against the base of a mixing chamber will be described.

FIG. 3*a* is a cross-sectional view of a LED strip 310*a*, taken perpendicular to the extension of the LED strip 310*a*. The LED strip 310*a* is equivalent to the LED strip 110 as described with reference to FIG. 2, except that it has a first lengthwise edge 114, and a second lengthwise edge 314 which is adapted to be arranged on the base of a mixing chamber. The second lengthwise edge 314 comprises a support 315*a* to facilitate the arrangement of the second lengthwise edge on the base of a mixing chamber (such as the mixing chamber 150 described with reference to FIG. 1). The support 315*a* extends from the first side of the LED strip orthogonally (i.e. at 90°). However, in other embodiments, a support may extend from the second side of the LED strip or at both sides of the LED strip. Further, the angle at which the support extends from the LED strip may be larger or smaller than 90°. The support 315*a* may form part of the LED strip 310.

FIG. 3*b* is an illustration of a LED strip 310*b* seen from the first side. The LED strip may be equivalent to the LED strip 310*a*. The LED strip 310*b* comprises five LEDs 111, and four supports 315*b*. It will be appreciated that the figure only shows a section of the LED strip. In this embodiment, the supports 315*b* extend at a right angle from the LED strip 310*b*. Each support 315*b* is arranged in between two successive LEDs 111. The supports 315*b* have a rectangular cross section.

Figure 3C:
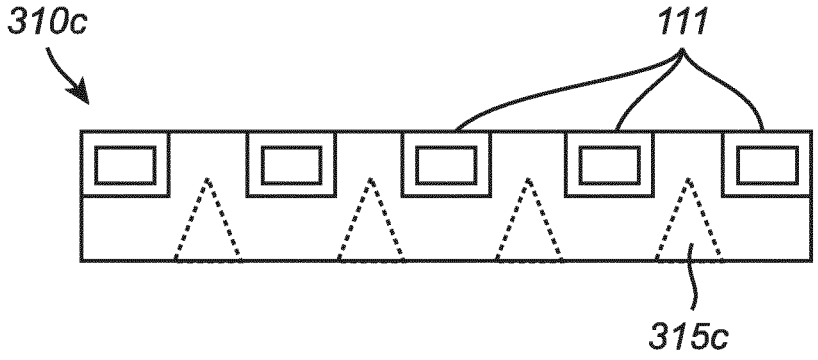

FIG. 3*c* is an illustration of another embodiment of a LED strip 310*c* which is equivalent to the LED strip 310*b* except that the supports 315*c* have triangular cross sections. One side of the triangular cross section is adapted to be arranged along the base of a mixing chamber, such as the mixing chamber 150 of FIG. 1.

Embodiments of the LED strip 310*a*, 310*b*, 310*c* may comprise a plurality of supporting elements like the supports described above. For example, embodiments of the LED strip may comprise more than 20 supporting elements/features. Some embodiments of the LED strip may comprise more than 30 supporting elements. Some embodiments of the LED strip may comprise more than 40 supporting elements. Specifically, in some embodiments of the LED strip, the supporting elements may be arranged so that each elongated arm comprises a supporting element. Further, in some embodiments of the LED strip, each elongated arm may comprise a plurality of supporting elements.

These embodiments show some examples of supports which may facilitate arrangement of an LED strip on the base of a mixing chamber. However, it will be appreciated that an LED strip in accordance with the various embodiments of the present disclosure may be arranged on the base of a mixing chamber without the aid of supports. For example, the arrangement may comprise some means of attachment, such as a mechanical means of attachment or an adhesive. Further, in some embodiments, the supports may be adapted to arrange the lengthwise edge of the LED strip at a distance from the base.

In relation to FIGS. 4*a-b*, arrangements including folding/bending of the LED strip will be described.

Figure 4A:
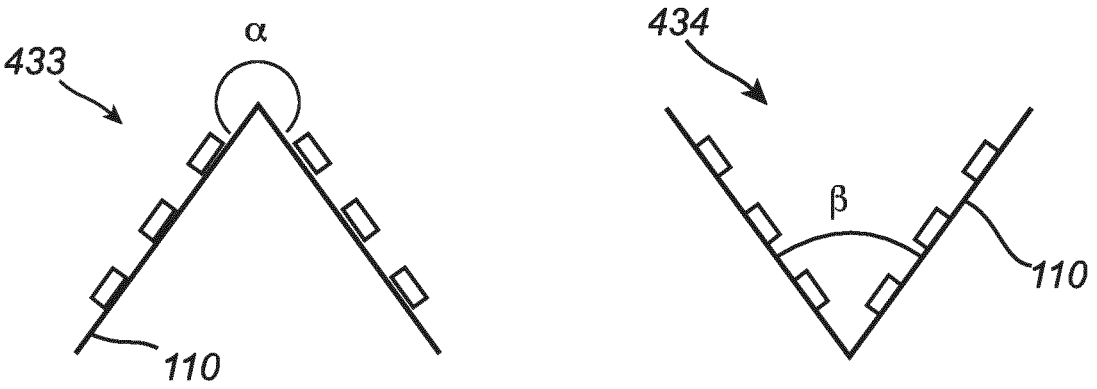
FIGS. 4*a-b* illustrate folding of an LED strip, in accordance with some embodiments.

FIG. 4*a* illustrates the folding of an elongated, flexible LED strip 110 with a mountain fold 433 and with a valley fold 434. In a mountain fold 433, the LED strip 110 is bent so that the angle α between two segments of the first side of the LED strip 110, one on each side of the fold, is increased such that $\alpha>180°$. A mountain fold 433, thus, results in an angle $\alpha$, between two segments of the first side of the LED strip 110, which is larger than 180°.

In a valley fold 434, the LED strip 110 is bent (folded) so that an angle $\beta$ between two segments of the first side of the LED strip, one on each side of the fold, is decreased such that $\beta<180°$. A valley fold 434 results in an angle $\beta$, between two segments of the first side of the LED strip 110, which is smaller than 180°.

Figure 4B:
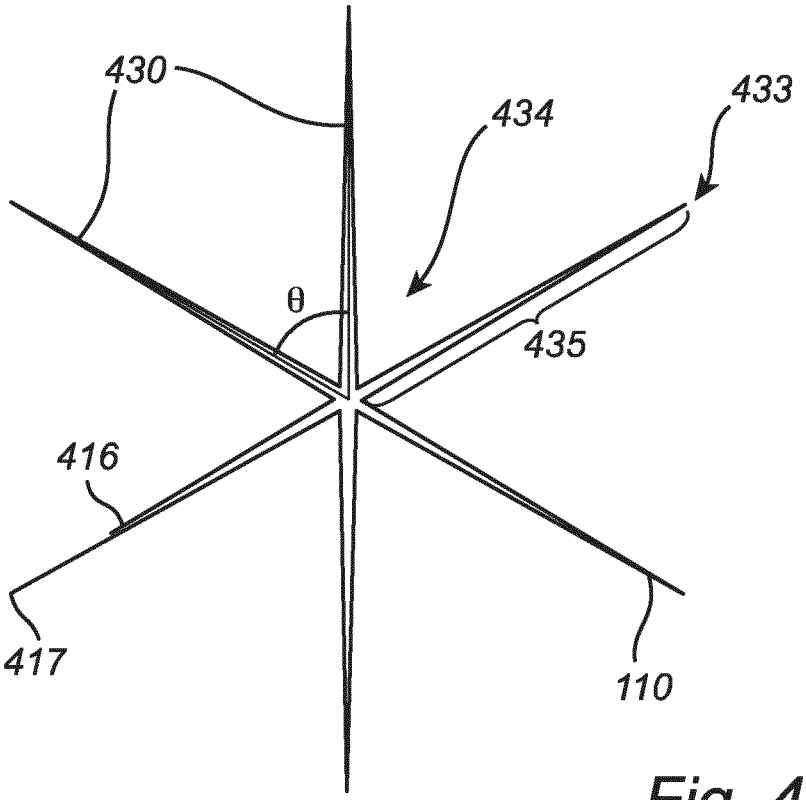

FIG. 4*b* shows an example of an arrangement of a LED strip 110. Not to obscure the figure, the LEDs of the LED strip 110 are not shown. However, the LED strip 110 may be equivalent to any of the LED strip 110 as described with reference to FIG. 2. The arrangement is formed by alternatively making valley folds 434 (at the center of the shape, arranged at the center portion of the base of the mixing chamber) and mountain folds 433 (forming the outer points of the shape). The present shape has six valley folds 434 at the center of the shape, and five mountain folds 433 making up five of the six outer points, as one outer point is made up of a first end point 416 and a second end point 417 of the bent/folded portion of the LED strip 110, and thus does not have a fold. In other embodiments, the end points 416, 417 may be located along an elongated arm, or at the center portion of the folded shape.

Segments 435 between a valley fold 434 and a mountain fold 433 may be substantially straight, as shown in the figure, giving the arrangement a star-like appearance.

The elongated arms are arranged so that the angle $\theta$ between (the centers of) two neighboring elongated arms is 360/N, N=6 being the number of elongated arms, thus forming a star-like shape with evenly distributed arms.

Figure 5A:
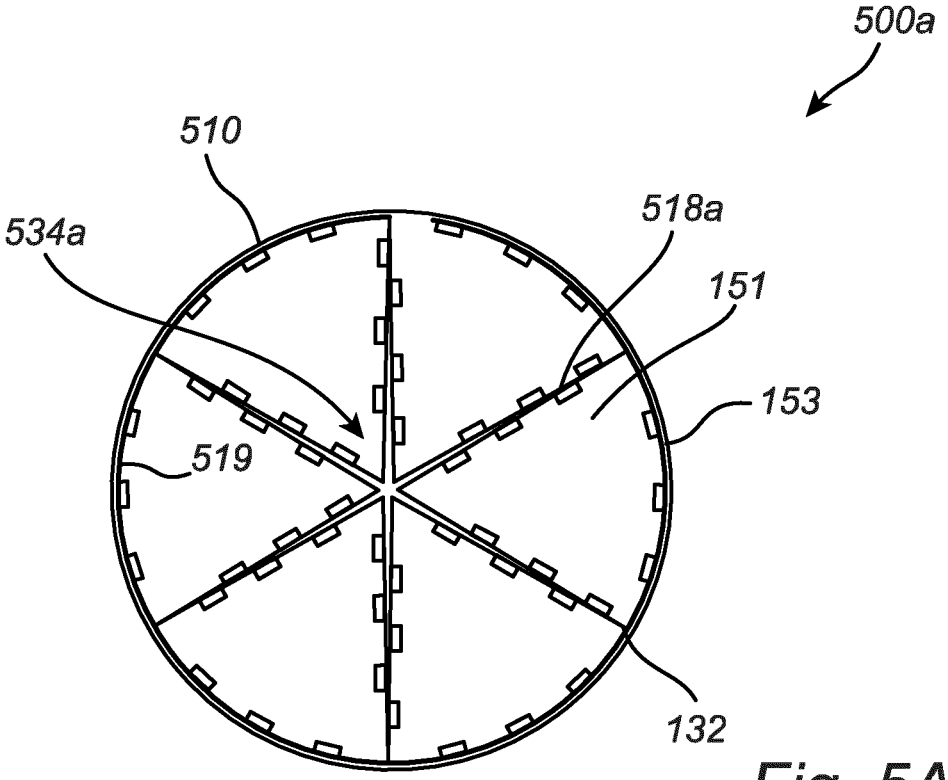
FIGS. 5*a-b* show schematic views of a LED strip on, or in the proximity of, the base of a mixing chamber, in accordance with some embodiments.
Figure 5B:
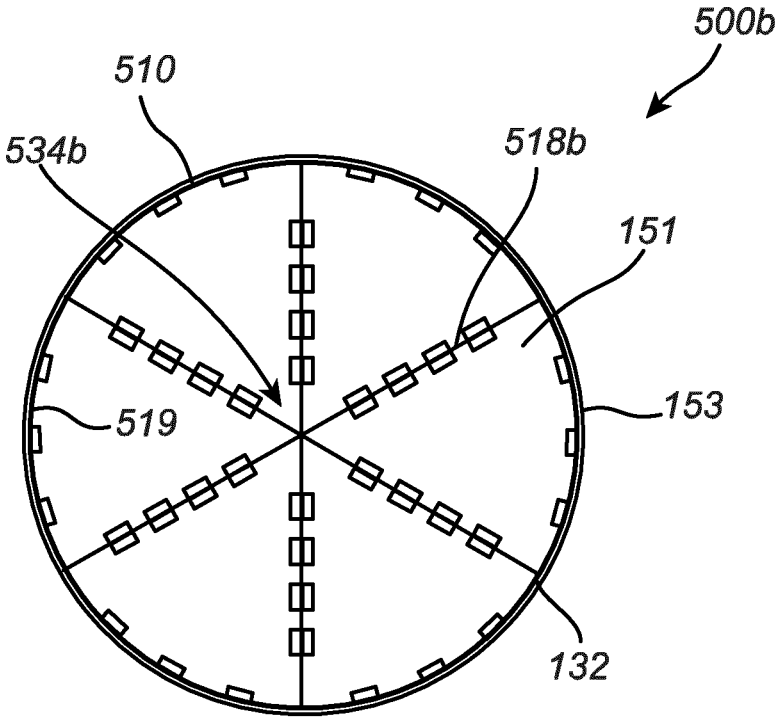

With reference to FIGS. 5*a-b*, different arrangements of a LED strip in which a portion of the LED strip is arranged along an arc of a circle will be described.

FIGS. 5*a-b* are plan views of LED strips 510 arranged on, in the proximity of, or above, the bases 151 of mixing chambers of light-emitting modules 500*a*, 500*b*, the light-emitting modules 500*a*, 500*b* being equivalent to the light-emitting module 100 described in relation to FIG. 1, except that the LED strips 510 comprise first portions 518*a*, 518*b* and second portions 519. The first portions 518*a*, 518*b* are folded to extend as elongated arms from the center portions of the respective bases 151 towards a number of outer points 132. The second portions 519 are arranged along an arc of a circle. Specifically, the portions 519 are arranged along the inner surface of the circumferential sidewalls 153, so that the LEDs of the LED strip 510 in the second portion 523 face into the mixing chamber.

In FIG. 5*a*, the folding/arrangement of the first portion 518*a* is such that there is a distance between the valley folds 534*a* at the center of the arrangement. As a result, the backsides (second sides) of the segments of the LED strip which make up opposite sides of an elongated arm are not in contact along the whole length of the elongated arm. Further, the LEDs on either side of an elongated arm are interleaved. Interleaving of the LEDs will be described with reference to FIG. 9.

In FIG. 5*b*, the folding/arrangement of the first portion 518*b* is such that there is substantially no distance between the valley folds 534*b* at the center of the arrangement. The backsides (second sides) of the segments which make up opposite sides of an elongated arm are at least partially in contact. More specifically, opposite sides are in contact along the whole length of the elongated arm. This arrangement may provide an even more uniform lighting.

Figure 6A:
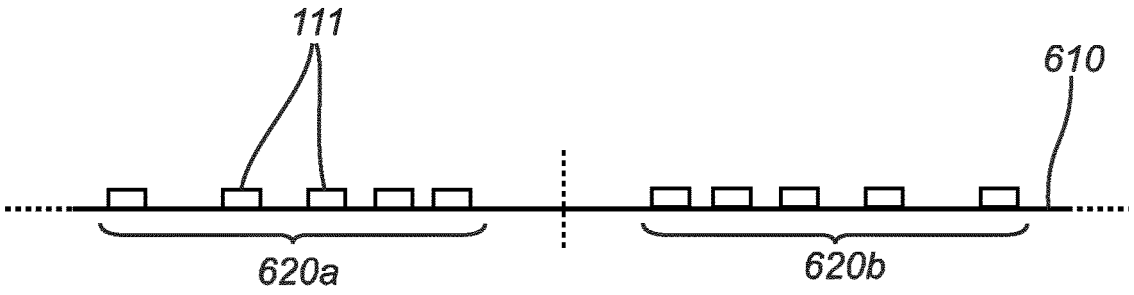
FIGS. 6*a-b* illustrate a LED strip having a LED pitch gradient, in accordance with some embodiments.
Figure 6B:
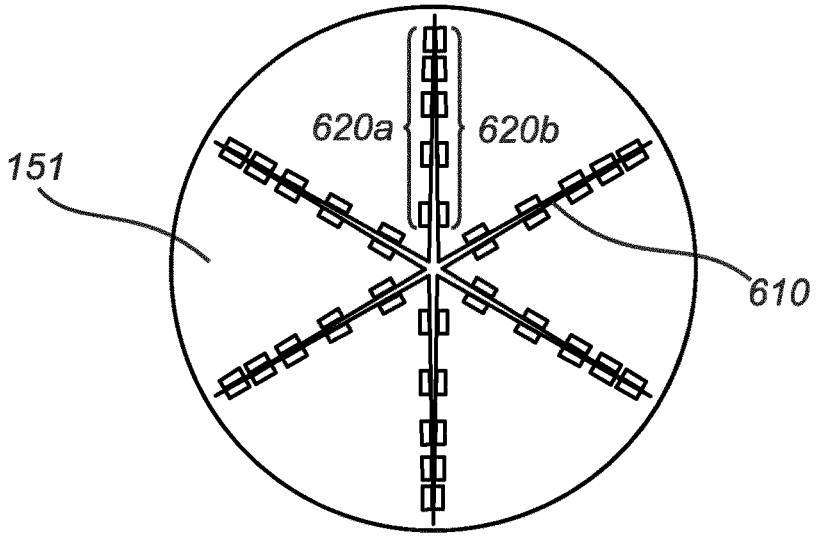

With reference to FIGS. 6*a-b*, an embodiment of a LED strip comprising a LED pitch gradient will be described.

FIG. 6*a* shows a portion of a LED strip 610. The LED strip 610 may be equivalent to the LED strip 110 described above with reference to FIG. 2, except that it comprises a first region 620*a* in which the LED pitch (i.e. the distance between two successive LEDs 111) decreases from left to right. The LED strip 610 further comprises a second region 620*b* in which the LED pitch increases from left to right. Each region 620*a*, 620*b* comprising a LED pitch may for example comprise at least 4 LEDs, between which the LED pitch (distance) increases or decreases. Specifically, each region 620*a*, 620*b* comprising a LED pitch may for example comprise at least 6 LEDs. More specifically, each region 620*a*, 620*b* comprising a LED pitch may for example comprise at least 7 LEDs.

FIG. 6*b* shows the LED strip 610 being arranged on, or in the proximity of, the base 151 of a mixing chamber, which may be equivalent to the mixing chamber 150 described with reference to FIG. 1. The LED strip has been folded with a mountain fold between the first region 620*a* and the second region 620*b*, so that the regions together form an elongated arm. The LED pitch decreases along the elongated arm, from the center portion of the base towards the outer point of the elongated arm. In the outer regions of the elongated arms, in which the elongated arms are more distant from one to another, the LEDs are more closely arranged. Thus, with this arrangement, the emitted light may be more uniformly spread.

Figure 7:
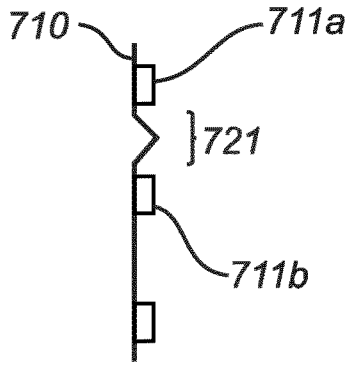
FIG. 7 shows a LED strip being folded to create a LED pitch gradient, in accordance with some embodiments.

With reference to FIG. 7, an embodiment in which a LED pitch gradient is provided by folding the LED strip will be described.

FIG. 7 is an illustration of a segment of a LED strip 710, which is equivalent to the LED strip 110 described with reference to FIG. 2, in accordance with some embodiments. The segment of the LED strip comprises a first LED 711*a* and a second, successive LED 711*b*. An area of the LED strip 721 between the first LED 711*a* and the second LED 711*b* is folded to decrease the pitch between the two LEDs 711*a*, 711*b*. This technique of folding the LED strip between LEDs may be used to adjust the LED pitch gradient along an elongated arm of a LED strip. This technique maybe used to form a light-emitting module such as for example described with reference to FIG. 6*b*.

Figure 8A:
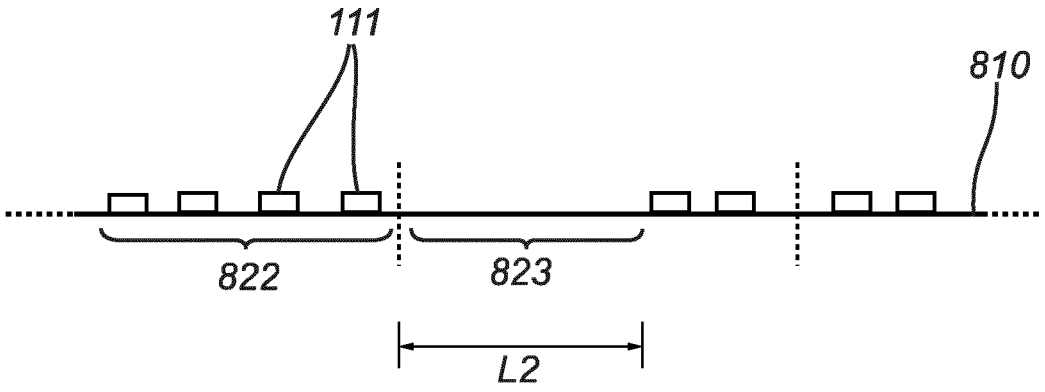
FIGS. 8*a-b* illustrate a LED strip having regions with LEDs and regions without LEDs, in accordance with some embodiments.
Figure 8B:
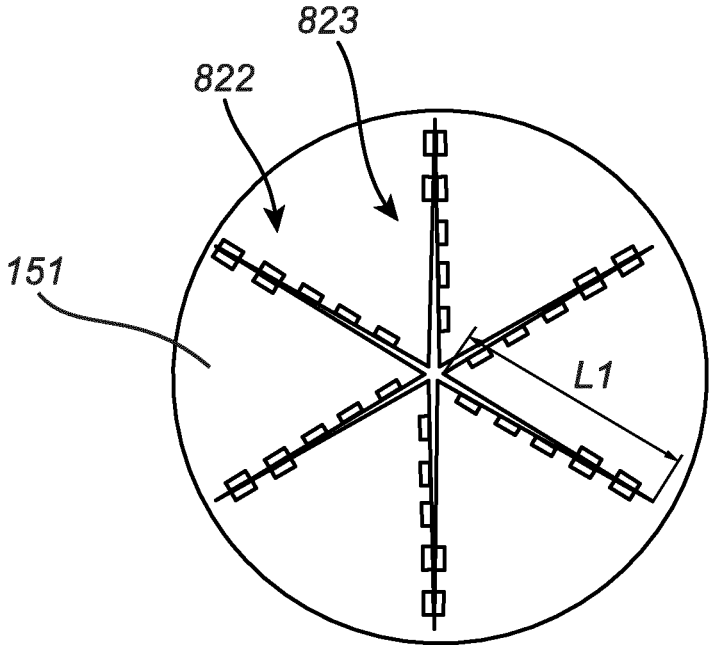

With reference to FIGS. 8*a-b*, an embodiment in which the LED strip comprises regions with LEDs and regions without LEDs will be described.

FIG. 8*a* illustrates a portion of an elongated, flexible LED strip 810. The LED strip 810 is similar to the LED strip 110 described with reference to FIG. 2 except that the LED strip 810 comprises a first region 822 with LEDs 111 and a second region 823 without LEDs.

FIG. 8*b* illustrates the LED strip 810 being arranged on, or in the proximity of, the base 151 of a mixing chamber. During folding of the LED strip, a valley fold has been formed between the first region 822 with LEDs 111 and the second region 823 without LEDs. As a result, the first region 822 and the second region 823 form part of two neighboring elongated arms (i.e. two different elongated arms), such that they face one another. As can be seen, the second region 823 without LEDs is located in proximity of the center portion of the base from which the elongated arms extend, such that the second region 823 without LEDs is a region of the LED strip located close to a region of a neighboring arm 822 having LEDs. In the present embodiment, the absence of LEDs in some regions where the elongated arms are closer to one-another may contribute to a more uniform illumination.

The length L2 of a region 823 without LEDs may be related to the length L1 of an elongated arm. For example, the relation between the length L2 of a region without LEDs and the length L1 of an elongated arm may be 0.4L1<L2<L1. Specifically, the relation may be 0.5L1<L2<L1. More specifically, the relation may be 0.7L1<L2<L1. Most specifically, the relation may be 0.9L1<L2<L1.

Specified differently, the length L2 of a region 823 without LEDs may be at least 3 cm. Specifically, the length L2 of a region 823 without LEDs may be at least 4 cm. More specifically the length L2 of a region 823 without LEDs may be at least 5 cm. Even more specifically, the length L2 of a region 823 without LEDs may be at least 6 cm.

Figure 9:
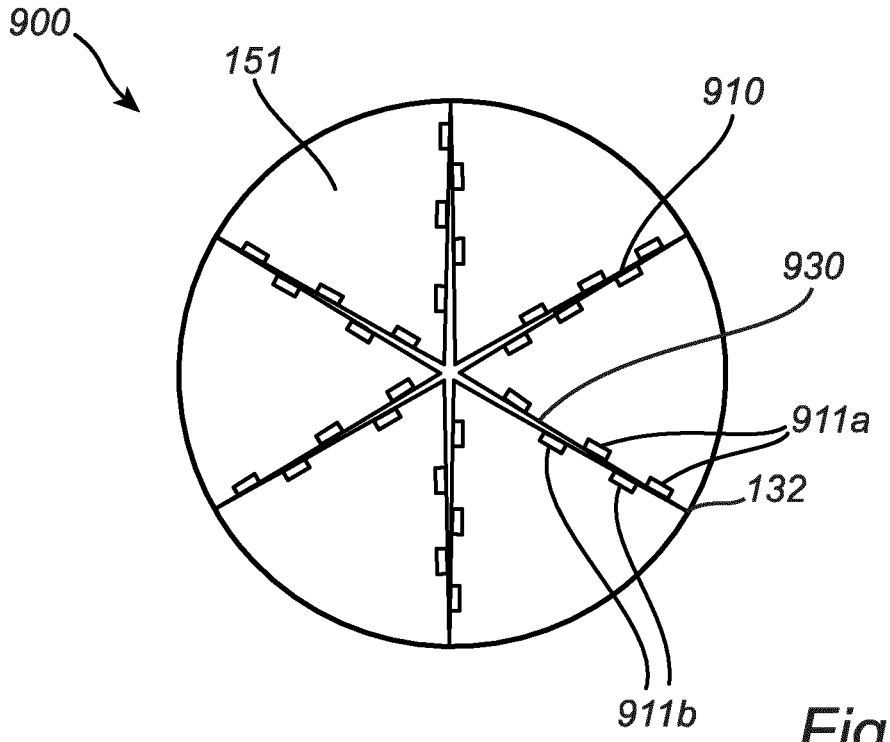
FIG. 9 shows a schematic view of an arrangement of a LED strip on, or in the proximity of, the base of a mixing chamber in which the LEDs on opposite sides of an elongated arm are interleaved, in accordance with some embodiments.

With reference to FIG. 9, an arrangement of a LED strip having LEDs being interleaved along an elongated arm will be described.

The light-emitting module 900 shown in FIG. 9 is equivalent to the light-emitting module 100 described with reference to FIG. 1 except that the LEDs 911*a* on one side of an elongated arm 930 and the LEDs 911*b* on the other (opposite) side of the elongated arm 930 are interleaved. As the LEDs 911*a* on one side of the elongated arm 930 are not placed at the same level (along the length of the elongated arm 930) as the LEDs 911*b* on the other side of the elongated arm 930, the heat development in the elongated arm may be more evenly spread out. This may lead to better thermal management.

Figure 10:
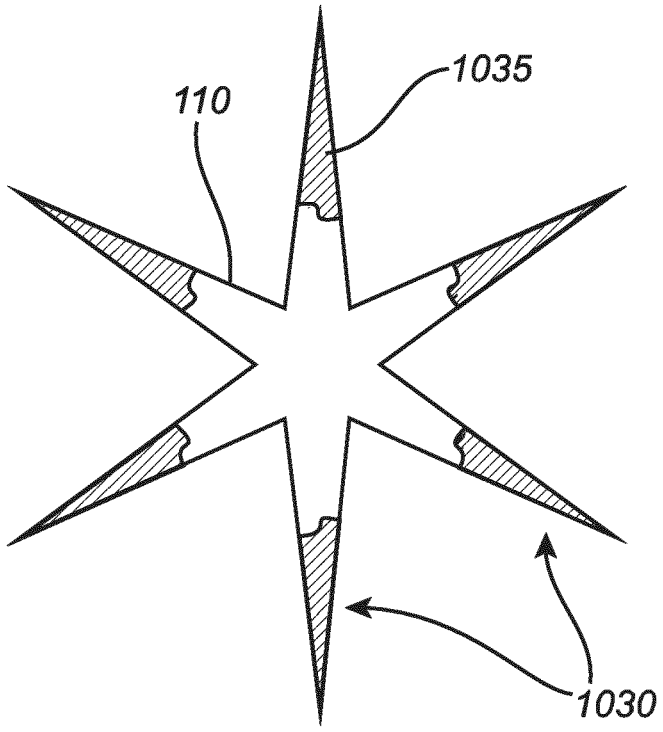
FIG. 10 illustrates a LED strip arrangement in which the second side of the LED strip is glued together at the outer points of the elongated arms, in accordance with some embodiments.

With reference to FIG. 10, an arrangement of a LED strip, in which the backsides of the LED strip (in the elongated arms) are glued together, in accordance with some embodiments, will be described.

FIG. 10 is an illustration of a LED strip 110. In order not to obstruct the illustration, the LEDs of the LED strip are not shown. The LED strip is bent/folded into a star-shaped arrangement. In a portion of each formed elongated arm 1030 of the LED strip arrangement, the backsides of the segments forming the elongated arm 1030 are glued together using an adhesive 1035. In the figure, the adhesive is placed in the outer portions of the elongated arms. However, in other embodiments, adhesive may be placed in other portions (one or more portions) of the elongated arms, or along the entire elongated arms. Adhesive on the backsides of the LED strip may improve thermal management.

Figure 11:
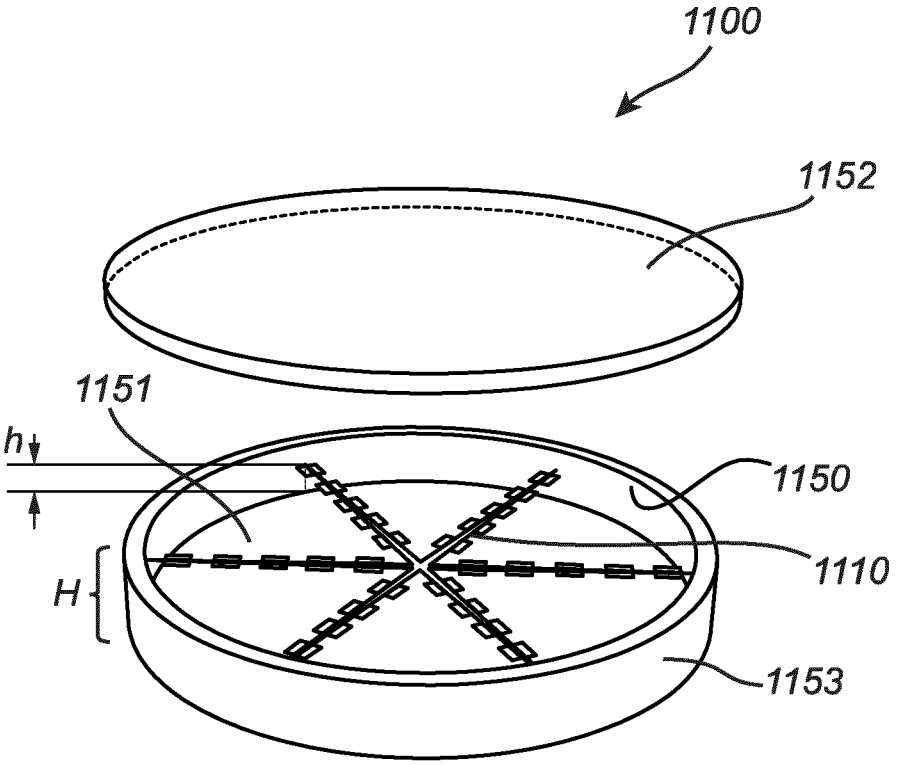
FIG. 11 illustrates a LED strip arrangement in which a lengthwise edge is arranged in proximity to the base of a mixing chamber, in accordance with some embodiments.

With reference to FIG. 11, an embodiment wherein the LED strip is arranged with a lengthwise edge in proximity to the base of a mixing chamber, in accordance with some embodiments, will be described.

The light-emitting module 1100 is equivalent to the light-emitting module 100 of FIG. 1*a*, except for that the LED strip 1110 is arranged with a small gap h between the base 1151 and the LED strip 1110. The LED strip 1110 in the present embodiment is attached at the inside of the sidewall 1153. The gap h is smaller than the height H of the mixing chamber 1150. Specifically, the gap h may be such that h<H/2. More specifically, the gap may be such that h<H/4. For example, the gap h may be smaller than 3 cm. Specifically, the gap h may be smaller than 1 cm. More specifically, the gap h may be smaller than 0.1 cm.

The person skilled in the art realizes that the present invention by no means is limited to the preferred embodiments described above. On the contrary, many modifications and variations are possible within the scope of the appended claims. For example, the LED strip segments forming the elongated arms may be in part curved, bent or folded to provide different illumination. Further, the arrangement of the LEDs on the LED strip may be varied. The shape and reflectance of the mixing chamber may be altered.

Although features and elements are described above in particular combinations, each feature or element can be used alone without the other features and elements or in various combinations with or without other features and elements.

Additionally, variations to the disclosed embodiments can be understood and effected by the skilled person in practicing the claims inventions, from a study of the drawings, the disclosure and the appended claims. In the claims, the word "comprising" does not exclude other elements, and the indefinite articles "a" or "an" do not exclude a plurality. The mere fact that certain features are recited in mutually different dependent claims does not indicate that a combination of these features cannot be used to advantage.

The invention claimed is:

1. A light-emitting module comprising:

one or more flexible, elongated light-emitting diode strips, each having a first side on which a plurality of light-emitting diodes is mounted, a second side opposite to the first side, and two lengthwise edges;

a mixing chamber arranged to mix light emitted by the light-emitting diodes, the mixing chamber having a base;

wherein one of the lengthwise edges of each of the one or more light-emitting diode strips is arranged to face the base of the mixing chamber;

wherein at least a portion of each of the one or more light-emitting diode strips is bent to extend radially from a center portion of the mixing chamber towards one or more outer points, so that the one or more light-emitting diode strips together form a number N of elongated arms, wherein said number N is larger than or equal to 3, wherein each elongated arm comprises two segments of one of the one or more light-emitting diode strips, the segments forming opposite sides of the elongated arm, and wherein the one or more flexible, elongated light-emitting diode strips being a flexible, elongated light-emitting diode strip of which at least a portion is bent to extend radially from the center portion of the mixing chamber towards a number N of outer points, thereby forming the number N of elongated arms.

2. The light-emitting module of claim 1, wherein each lengthwise edge facing the base of the mixing chamber is arranged against the base or in proximity of the base.

3. The light-emitting module of claim 1, wherein at least a segment of at least one of the one or more light-emitting diode strips along an elongated arm of the light-emitting diode strip comprises a light-emitting diode pitch gradient, such that the light-emitting diode pitch decreases from the center portion towards the outer point of the elongated arm.

4. The light-emitting module of claim 1, wherein at least a section of at least one of the one or more light-emitting diode strips, between a first light-emitting diode and a second, successive light-emitting diode, is folded to shorten the pitch between the first light-emitting diode and the second light-emitting diode.

5. The light-emitting module of claim 1, wherein the light-emitting diodes on at least one of the one or more light-emitting diode strips are arranged so that the light-emitting diode strip comprises regions with light-emitting diodes and regions without light-emitting diodes, and wherein each region without light-emitting diodes is arranged along a side of an elongated arm facing a side of a neighboring elongated arm having light-emitting diodes.

6. The light-emitting module of claim 1, wherein two neighboring arms are arranged at an angle θ, wherein θ=360/N.

7. The light-emitting module of claim 1, wherein at least a portion of at least one of the one or more light-emitting diode strips is arranged along an arc of a circle between the outer points of at least two elongated arms.

8. The light-emitting module of claim 7, wherein at least one segment of the light-emitting diode strip, forming a side of an elongated arm from one of the at least (N - 1) mountain folds to one of the at least (N - 1) valley folds, is substantially straight, thereby forming a star-like shape.

9. The light-emitting module of claim 1, wherein the light-emitting diode strip is arranged with at least (N - 1) valley folds at the center portion of the mixing chamber, and at least (N - 1) mountain folds forming the N outer points.

10. The light-emitting module of claim 1, wherein, in at least a portion of an elongated arm, the two segments forming opposite sides of the elongated arm are glued together on the second side of the light-emitting diode strip.

11. The light-emitting module of claim 1, wherein the light-emitting diodes are arranged on at least one of the one or more light-emitting diode strips so that light-emitting diodes on the opposite sides of an elongated arm are interleaved.

12. The light-emitting module of claim 1, wherein the mixing chamber further comprises a semi-reflective light exit window at least partially transmissive for visible light, the semi-reflective light exit window being arranged to couple out light emitted from the plurality of light-emitting diodes and mixed within the mixing chamber.

13. The light-emitting module of claim 1, wherein the mixing chamber has a width (W1) and a height (H), and wherein an aspect ratio of the width (W1) and the height (H) is in the range of 8 to 60.

14. A method for producing a light-emitting module of claim 1, the method comprising:

providing the mixing chamber;

providing the one or more flexible, elongated light-emitting diode strips;

arranging, for each of the one or more light-emitting diode strips, one of the lengthwise edges to face the base of the mixing chamber; and bending at least a portion of each of the one or more light-emitting diode strips to extend radially from a center portion of the mixing chamber towards one or more outer points, so that the one or more light-emitting diode strips together form the number N of elongated arms.

* * * * *